US007454914B2

(12) United States Patent
Prociw

(10) Patent No.: US 7,454,914 B2
(45) Date of Patent: Nov. 25, 2008

(54) HELICAL CHANNEL FOR DISTRIBUTOR AND METHOD

(75) Inventor: Lev Alexander Prociw, Elmira (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 25 days.

(21) Appl. No.: 11/614,649

(22) Filed: Dec. 21, 2006

(65) Prior Publication Data

US 2007/0101727 A1 May 10, 2007

Related U.S. Application Data

(62) Division of application No. 10/743,712, filed on Dec. 24, 2003, now Pat. No. 7,174,717.

(51) Int. Cl.
*F23R 3/28* (2006.01)
*F23R 3/14* (2006.01)

(52) U.S. Cl. ..... 60/772; 29/889.2; 29/890.02; 60/776

(58) Field of Classification Search ..... 60/737, 60/748, 740, 743, 742, 776, 772; 29/889.2, 29/889.02

See application file for complete search history.

(56) References Cited

U.S. PATENT DOCUMENTS

| | | | | | |
|---|---|---|---|---|---|
| 1,713,357 | A * | 5/1929 | St Clair | 239/464 |
| 3,337,135 | A * | 8/1967 | Blakely et al. | 239/402 |
| 5,067,655 | A * | 11/1991 | Farago et al. | 239/124 |
| 5,174,504 | A * | 12/1992 | Halvorsen | 239/410 |
| 5,243,816 | A * | 9/1993 | Huddas | 60/740 |
| 5,423,173 | A * | 6/1995 | Lemon et al. | 60/776 |
| 5,701,732 | A * | 12/1997 | Nesbitt et al. | 60/776 |
| 6,247,317 | B1 * | 6/2001 | Kostka | 60/741 |
| 6,340,015 | B1 * | 1/2002 | Benedikt et al. | 123/297 |
| 6,382,189 | B1 * | 5/2002 | Hlousek | 123/506 |
| 7,174,717 | B2 * | 2/2007 | Prociw | 60/740 |

* cited by examiner

*Primary Examiner*—Ted Kim
(74) *Attorney, Agent, or Firm*—Ogilvy Renault LLP

(57) ABSTRACT

A method of distributing fuel in a fuel nozzle comprises: providing at least two helical channels in the fuel nozzle, each having a channel exit port, providing a fuel inlet cavity in fluid communication with the helical channels, and flowing fuel in the fuel inlet cavity, the helical channels and the channel exit ports.

13 Claims, 5 Drawing Sheets

HELICAL CHANNEL FOR DISTRIBUTOR AND METHOD

This application is a divisional of U.S. patent application Ser. No. 10/743,712, filed Dec. 24, 2003 U.S. Pat. No. 7,174,717 issued on Feb. 13, 2007.

FIELD OF THE INVENTION

The present invention relates to gas turbine engines, and more particularly to a fuel nozzle for such gas turbine engines.

BACKGROUND ART

Fuel nozzles of gas turbine engines usually comprise a fuel distributor for dividing the fuel in several equal streams in order to develop a uniform fuel film. The fuel distributor is often also responsible for swirling the fuel streams to obtain a good fuel spray distribution.

Fuel distributors usually comprise a sealed disk element having a plurality of circumferentially spaced apart small metering holes or slots. The disk is usually mounted on a cylindrical channel adapted to deliver the fuel. The small metering holes are drilled with an axial as well as a circumferential orientation in order to provide a swirl to the fuel passing therethrough.

This configuration poses several problems, one of which is the fact that drilling identical holes of such a small size can be very difficult. If sufficient similarity between metering hole sizes is not achieved, the fuel film is not uniform, causing a poor spray quality. In addition, holes of such a small size are very susceptible to contamination or plugging.

Another problem with the prior art is that the channels upstream of the metering holes are exposed to a high amount of heat input through adjacent walls due to external heat transfer from hot air to the cool walls. This can lead to coke formation and hole plugging.

Also, the resistance of the metering holes is often insufficient to reach the desired nozzle resistance value, and a tuning orifice is often required at the inlet of the nozzle to compensate.

Finally, the disk is usually sealed with braze to prevent unmetered fuel from escaping around the metering holes. This presents a risk in manufacturing since braze can run into the metering holes, blocking them after the braze sets.

Accordingly, there is a need for an improved fuel distributor that overcomes the above-mentioned problems of the prior art.

SUMMARY OF INVENTION

It is therefore an aim of the present invention to provide an improved fuel distributor.

Further in accordance with an aspect of the present invention, there is provided a method of fabricating a fuel distributor adapted to swirl fuel in a combustor assembly of a gas turbine engine, comprising: providing an elongated cylindrical member; forming at least two helical grooves along an axially extending outer surface of the elongated cylindrical member, each helical grooves defining at least one complete turn, forming one end of the elongated cylindrical member so as to produce a frustro-conical surface at the end, such that radially outwardly oriented channel exit ports are created where the helical grooves intersect the frustro-conical surface; and fitting the elongated cylindrical member into a tubular member such that the cooperation of an inner surface of the tubular member with the outer surface having helical grooves forms independent helical channels adapted to communicate fuel. Also in accordance with an aspect of the present invention, there is provided a method of distributing fuel in a fuel nozzle of a combustor assembly of a gas turbine engine, the method comprising: providing at least two helical channels in the fuel nozzle, each helical channels having a helix axis and a channel exit port axially aligned with the helix axis; and flowing fuel from a fuel inlet cavity, through the helical channels and the channel exit ports and into a surrounding flow of air.

BRIEF DESCRIPTION OF THE DRAWINGS

Reference will now be made to the accompanying drawings.

DESCRIPTION OF THE PREFERRED EMBODIMENTS

Figure 1:
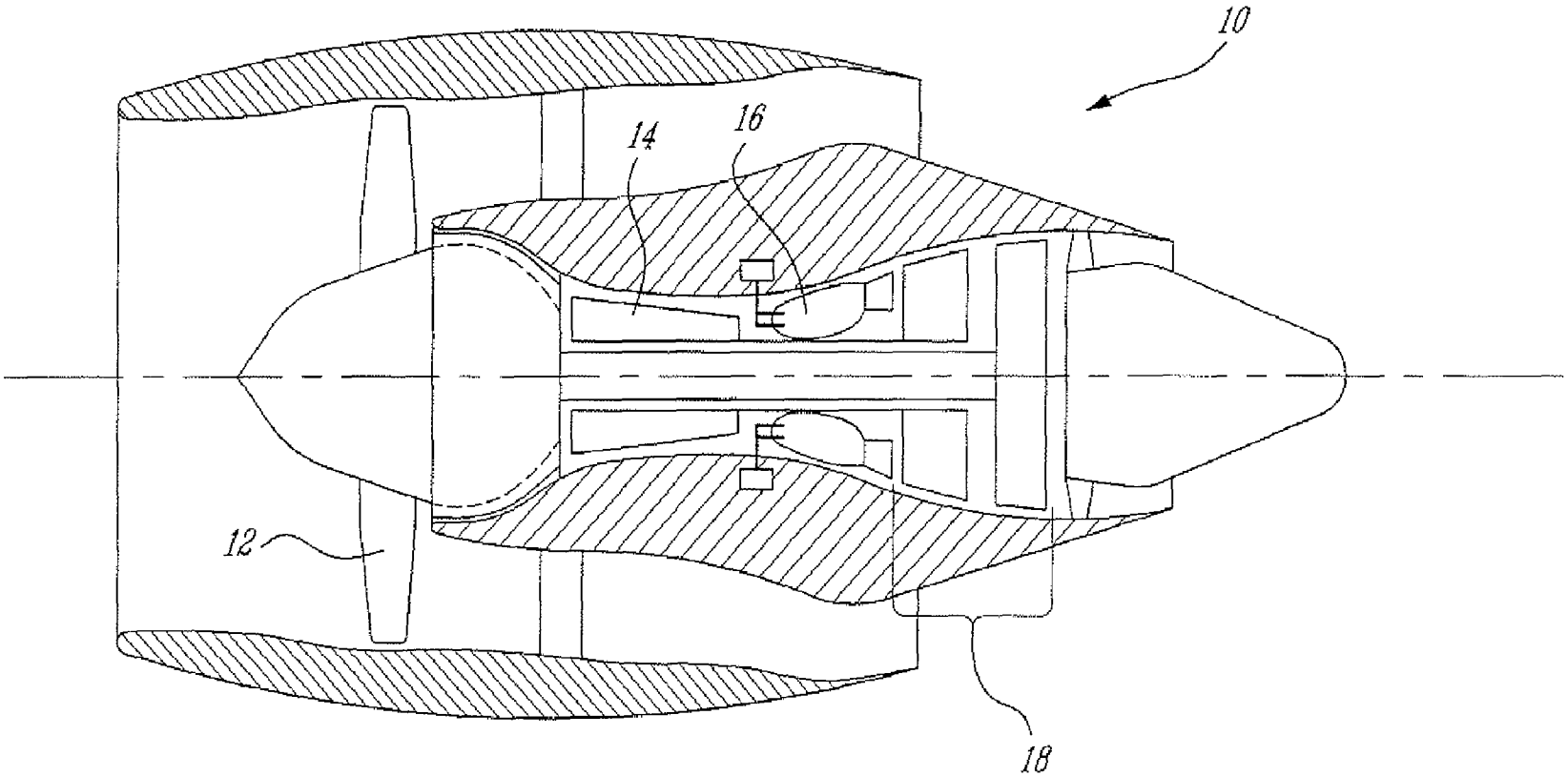
FIG. 1 is a side view of a gas turbine engine, in partial cross-section, exemplary of an embodiment of the present invention.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine 18 for extracting energy from the combustion gases.

Figure 2:
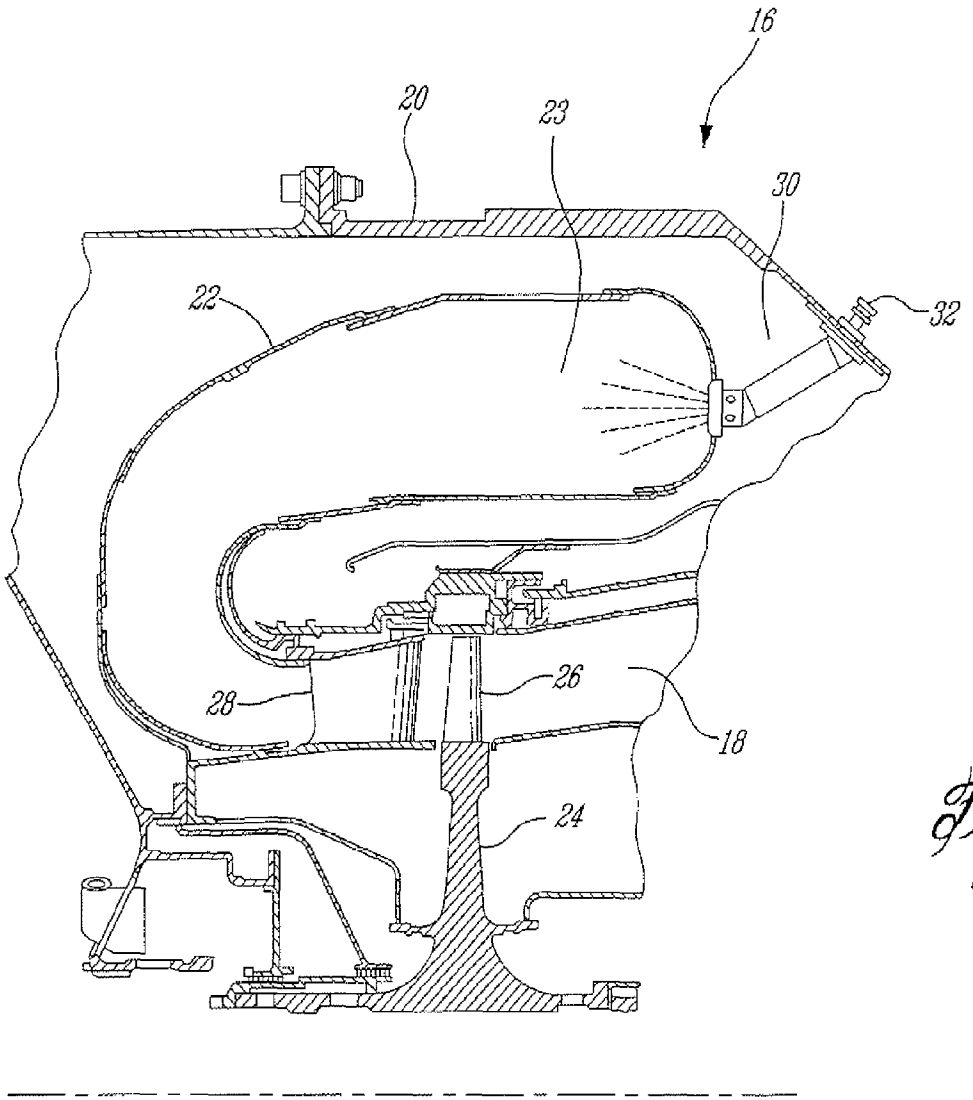
FIG. 2 is a simplified side view of a combustor of a gas turbine engine, in cross-section, exemplary of an embodiment of the present invention.

Referring to FIG. 2, the combustor section 16 is shown. The combustor section 16 includes an annular casing 20 and an annular combustor tube 22 concentric with the turbine section 18 and defining a combustor chamber 23. The turbine section 18 is shown with a typical rotor 24 having blades 26 and a stator vane 28 upstream from the blades 26.

A fuel nozzle 30 is shown as being located at the end of the annular combustor tube 22 and directly axially thereof. The fuel nozzle 30 includes a fitting 32 to be connected to a typical fuel line. There may be several fuel nozzles 30 located on the wall of the combustion chamber, and they may be circumferentially spaced apart. For the purpose of the present description, only one fuel nozzle 30 will be described.

Figure 3:
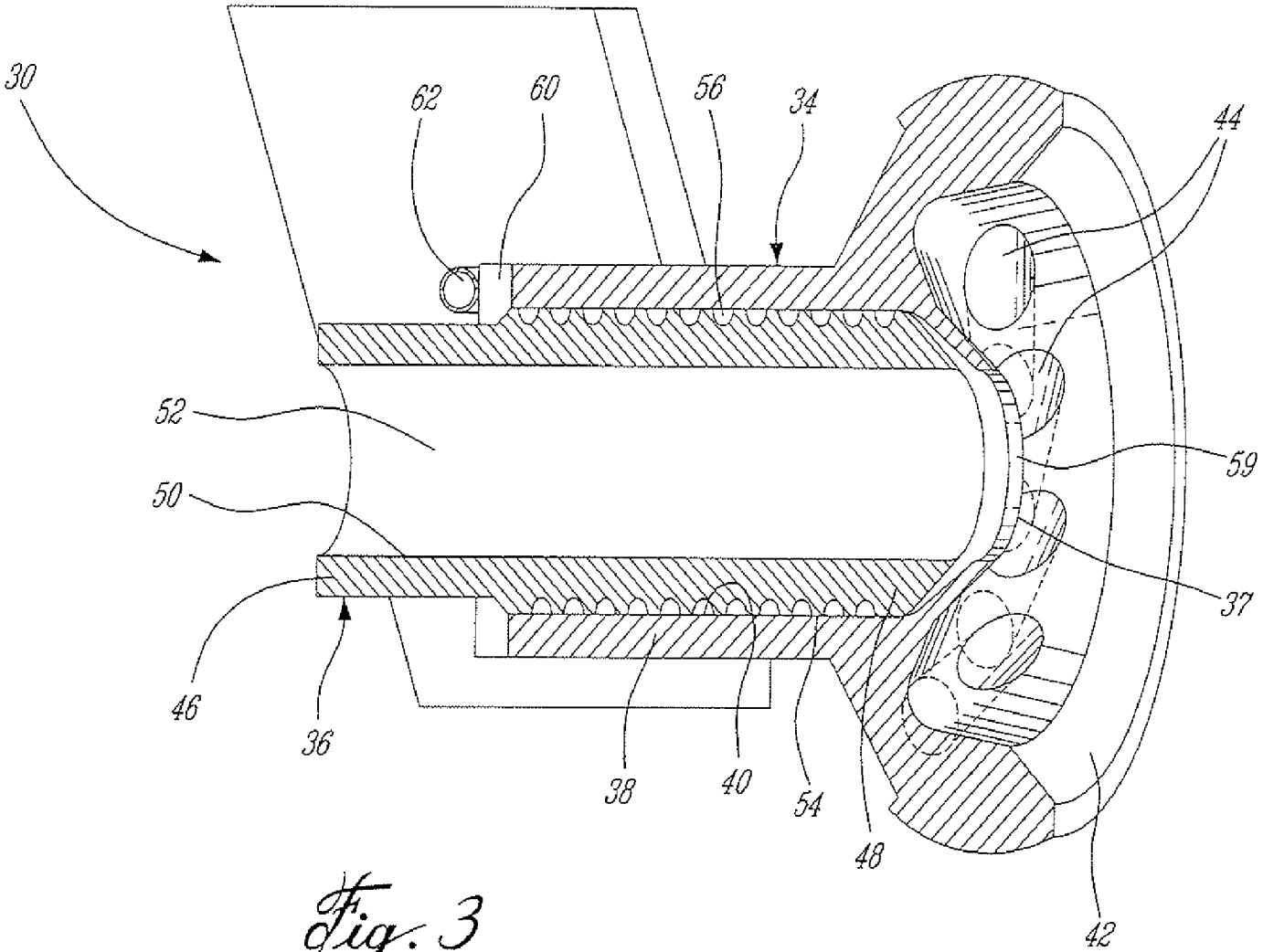
FIG. 3 is side view, in cross-section, of a fuel nozzle according to a preferred embodiment of the present invention.
Figure 4:
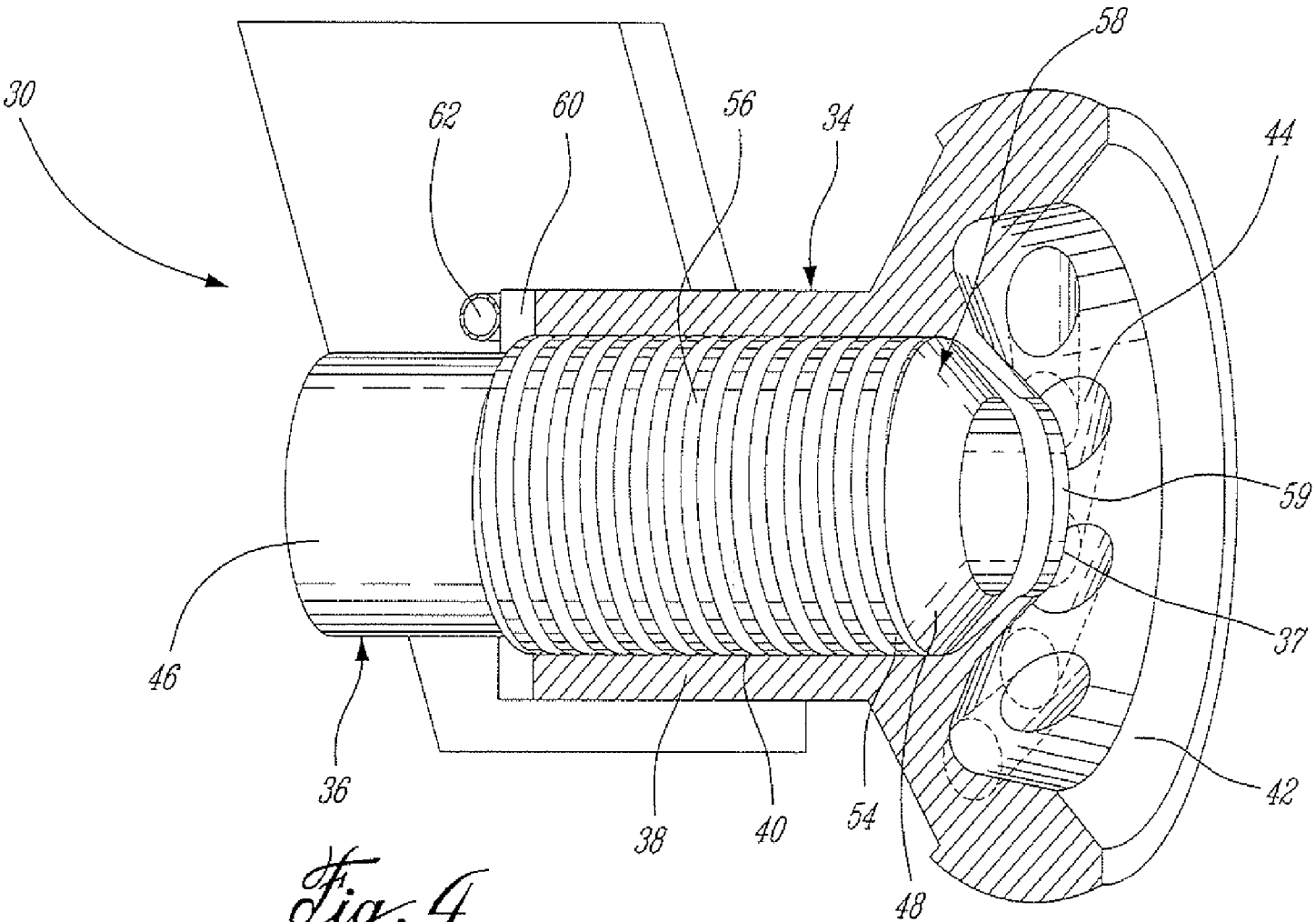
FIG. 4 is a side view, in partial cross-section, of the fuel nozzle of FIG. 3.

Referring to FIGS. 3 and 4, a fuel nozzle 30 according to a preferred embodiment of the invention is shown. The fuel nozzle 30 comprises an air swirler 34 and a fuel distributor 36. The fuel nozzle also comprises a fuel filmer lip 37 having the function of generating a fuel film from the swirled fuel received from the fuel distributor 36.

The air swirler 34 comprises a tubular body 38 including an inner surface 40 defining a central bore adapted to receive the fuel distributor 36. The air swirler 34 also comprises outer air swirling means of a type similar to outer air swirling means of fuel injectors known in the art, such as is described in U.S. Pat. No. 6,082,113, issued Jul. 4, 2000 to the applicant, which is incorporated herein by reference. Preferably, the outer air swirling means include an air swirler frustro-conical ring 42 having a plurality of circumferentially spaced apart bores 44. The axis of each bore 44 has an axial as well as a circumferential component so as to be able to swirl the air passing therethrough.

The fuel filmer lip 37 is located at the junction of the inner surface 40 and frustro-conical ring 42 of the air swirler.

Figure 5:
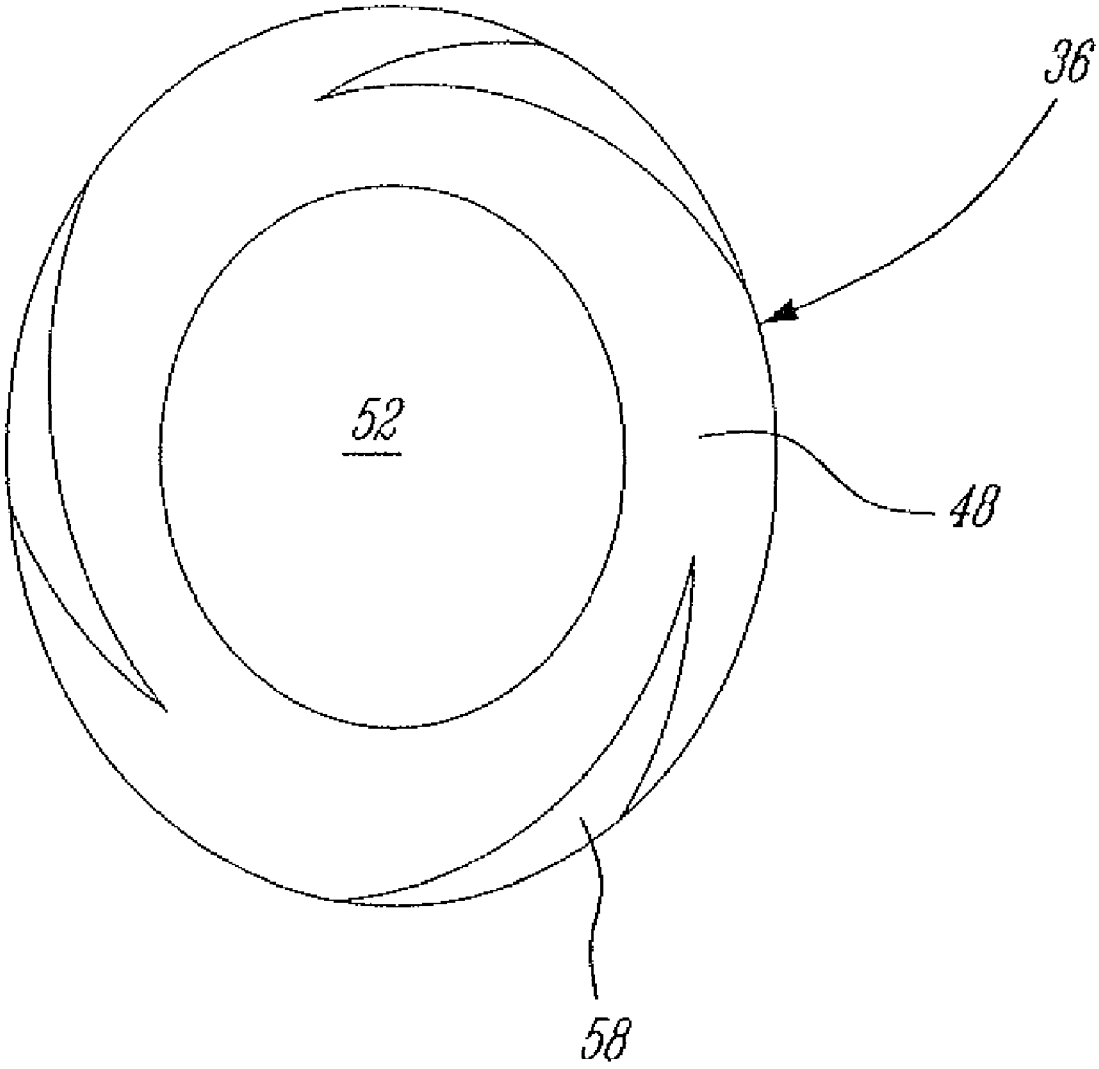
FIG. 5 is a front view of a fuel distributor of the fuel nozzle of FIG. 3.

The fuel distributor 36 comprises a tubular body 46 having a frustro-conical end 48. The tubular body 46 includes an inner surface 50 defining a cylindrical core air passage 52. The tubular body 46 also includes an outer surface 54 having a plurality of helical grooves 56. In a preferred embodiment, three helical grooves 56 are defined in the outer surface 54 and are helically parallel to one another, i.e. the grooves are interlaced so that three successive grooves along an axial line will belong respectively to the first, second and third helical groove. Once the fuel distributor 36 is fitted into the air swirler 34, the inner surface 40 of the air swirler 34 cooperates with the outer surface 54 of the fuel distributor 36 so that each helical groove 56 defines a closed helical channel. Each helical channel is in fluid communication with an inlet fuel cavity 60 receiving fuel from a fuel inlet 62. The intersection of a surface of the frustro-conical end 48 with an end of each helical groove 56 creates channel exit ports 58, as can best be seen in FIG. 5. The shape of the channel exit ports 58 contributes to the swirl of the fuel in a fuel swirling chamber 59 defined between the frustro-conical end 48 of the fuel distributor 36 and the fuel filmer lip 37.

The helical grooves 56 and frustro-conical end 48 are preferably formed by standard turning operations. The fuel distributor 36 is preferably shrink-fit into the air swirler 34. The shrink-fit allows the inner surface 40 of the air swirler 34 and the outer surface 54 of the fuel distributor 36 to cooperate so that the helical grooves 56 can define sealed fuel channels without the need for braze.

It is considered to provide helical grooves 56 with a depth progressively shallower toward the frustro-conical end 48 in order to decrease the pressure drop in the beginning of each channel (i.e. near the fuel inlet 60) and increase it toward the end thereof (i.e. near the frustro-conical end 48). The channel exit ports 58 can be designed so as to have an exit flow area similar to that provided by the metering holes of the prior art in order to obtain similar filming of fuel.

It is also contemplated to define the helical grooves into the inner surface 40 of the air swirler 34 to obtain the closed helical channels in cooperation with the outer surface 54 of the fuel distributor 36, the outer surface 54 being continuous. Alternatively, both the air swirler inner surface 40 and fuel distributor outer surface 54 can have helical grooves defined therein to form the helical channels.

During operation, the pressurized fuel enters the fuel inlet 60 and fills the fuel inlet cavity 62. The fuel pressure than forces the fuel in the helical channels defined by the helical grooves 56. The fuel in each helical channel exits through the corresponding channel exit port 58. The helical motion of the fuel through the helical channels and the shape of the channel exit ports 58 both contribute to producing a swirl in the fuel exiting the fuel distributor 36 and entering the fuel swirling chamber 59. The swirling fuel is then transformed into a fuel film in a manner similar to standard fuel nozzles, by the interaction of the fuel swirling out of the swirling chamber 59 through an opening defined by the fuel filmer lip 37 with air exiting the core air passage 52. The fuel film is then atomized by contact with swirling air coming from the bores 44 of the frustro conical ring 42 of the air swirler 34. It is also possible to omit the fuel filmer lip 37 so that the fuel exiting from the exit ports 58 is directly atomized by the swirling air without being transformed into a fuel film.

The present invention presents several improvements over the prior art. Since the flow resistance of the nozzle is distributed over the length of the channels rather than across metering holes, a better uniformity of resistance can be achieved which results in a more accurate fuel division. Also, since the helical grooves 56 are formed by standard turning operations, the dimensions of the helical channels can be highly accurate and the operation is less expensive than drilling small metering holes. Forming the channels through standard turning operations allows for easy selection of the length of the channels, which is a function of the pitch of the helical grooves, and of the depth of the channels, whether constant or variable along the channel length. The depth and length of the channels can therefore be chosen so as to tune the pressure drop of the fuel flowing therethrough, and this pressure drop distribution will have several effects on the fuel flow. Tuning the overall pressure drop of a nozzle provides tuning of its resistance with respect to the other nozzles of the combustor. This allows for balancing the flow among various nozzles without the need for a traditional tuning orifice, which reduces fabrication costs. The pressure drop of an individual channel can also be set so as to balance the resistance, thus the fuel flow, among the channels of a same nozzle. The channel length also as a great influence on the rate of heat transfer of the fuel flowing therethrough. Helical channels have the advantage of being much longer than straight channels, which provides for greater heat transfer along the channel. This contributes to reducing fabrication costs since heat transfer in the nozzle tip is reduced, eliminating requirement for additional heat shields. Finally, the depth of each channel can be selected in order to obtain a desired fuel velocity. Since smaller channels will induce a higher fuel velocity, the helical fuel channels, which are smaller then conventional channels, will provide a higher fuel velocity, thus less coke deposition on the channel walls.

The embodiments of the invention described above are intended to be exemplary. Those skilled in the art will therefore appreciate that the forgoing description is illustrative only, and that various alternatives and modifications can be devised without departing from the spirit of the present invention. For example, any desired depth profile and groove cross-section may be used, and not all grooves need to be the same. Any number of grooves may be provided, and they may be provided by any suitable manufacturing method. Other apparatus may be provided having the described groovelike effect. The present distributor may be used alone, or in conjunction with prior art or other distribution and/or swirler apparatus. Accordingly, the present is intended to embrace all such alternatives, modifications and variances which fall within the scope of the appended claims.

I claim:

1. A method of fabricating a fuel distributor adapted to swirl fuel in a combustor assembly of a gas turbine engine, the method comprising:

a) providing an elongated cylindrical member having a central air passage;

b) forming at least two helical grooves along an axially extending outer surface of the elongated cylindrical member to obtain a grooved surface, each of the helical grooves defining at least one complete turn;

c) forming a frustro-conical surface at one end of the grooved surface of the elongated cylindrical member such that radially outwardly oriented channel exit ports are created where the helical grooves intersect the frustro-conical surface; the channel exit ports being tangential to the outer frustro-conical surface and d) fitting the elongated cylindrical member into a tubular member such that the cooperation of an inner surface of the tubular member with the outer surface having helical grooves forms independent helical channels adapted to communicate fuel swirlingly to the combustor assembly.

2. The method according to claim 1, wherein step a) comprises defining an axially extending cylindrical bore through the cylindrical member, the at least two helical grooves being concentrically disposed relative to said cylindrical bore.

3. The method according to claim 1, wherein step d) comprises press-fitting the cylindrical member into the tubular member.

4. The method according to claim 3, wherein the cylindrical member is shrink-fit into the tubular member.

5. The method according to claim 1, wherein step b) comprises forming the at least two helical grooves by turning the cylindrical member.

6. A method of distributing fuel in a fuel nozzle of a combustor assembly of a gas turbine engine, the method comprising:

(a) providing at least two helical channels defining at least one complete turn in the fuel nozzle about a core air passage, each of the helical channels having a helix axis and a channel exit port axially aligned with the helix axis; each helical channel being formed on a cylindrical member with a frustro-conical end surface defining the channel exit port; and (b) flowing fuel from a fuel inlet cavity, through the helical channels and the channel exit ports and into a swirling surrounding flow of air; and (c) discharging the fuel with a swirled fashion in the surrounding swirling flow of air.

7. The method according to claim 6 wherein step a), comprises defining at least two helical grooves in a first cylindrical surface, and sealingly covering the helical grooves in the first cylindrical surface with a second cylindrical surface, and wherein the fuel defines several turns while flowing along the helical channels.

8. The method according to claim 7, wherein the first cylindrical surface is an outer surface of a first body, the second cylindrical surface is an inner surface of a second body, and wherein step a) comprises concentrically fitting the first body into the second body.

9. The method according to claim 6, wherein step a) comprises sizing at least one helical fuel channel to obtain a desired fuel distribution among the helical fuel channels.

10. The method according to claim 6, comprising tuning a nozzle flow resistance by selecting a depth and length of the helical fuel channels.

11. The method according to claim 6, wherein step a) further comprises selecting a length of the helical fuel channels in order to obtain a desired heat transfer.

12. The method according to claim 6 comprising controlling a fuel pressure drop by sizing the helical fuel channels.

13. The method according to claim 6, comprising controlling the fuel velocity by sizing the helical fuel channels.

* * * * *